US011027451B2

(12) United States Patent
Song

(10) Patent No.: US 11,027,451 B2
(45) Date of Patent: Jun. 8, 2021

(54) FILM CUTTING APPARATUS

(71) Applicant: Samsung Display Co., Ltd., Yongin-si (KR)

(72) Inventor: Jae Suk Song, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/445,916

(22) Filed: Jun. 19, 2019

(65) Prior Publication Data

US 2020/0164541 A1 May 28, 2020

(30) Foreign Application Priority Data

Nov. 28, 2018 (KR) ..... 10-2018-0150051

(51) Int. Cl.

| | |
|---|---|
| ***B26F 1/38*** | (2006.01) |
| *B26D 7/00* | (2006.01) |
| *B26F 1/40* | (2006.01) |

(52) U.S. Cl.

CPC ..... *B26F 1/386* (2013.01); *B26D 7/0006* (2013.01); *B26D 2210/11* (2013.01); *B26F 2001/407* (2013.01)

(58) Field of Classification Search

CPC .... B26F 1/386; B26F 2001/407; B26F 1/405; B26F 1/40; B26B 13/00; B26D 2201/11; B26D 7/0006; Y10T 83/8702–8704; Y10T 83/8716; Y10T 83/8776; Y10T 83/8733; Y10T 83/8748

See application file for complete search history.

(56) References Cited

U.S. PATENT DOCUMENTS 4,064,917 A * 12/1977 Diaz ..... H01L 21/67138 140/105
2012/0227555 A1* 9/2012 Kim ..... B26F 1/40 83/55

FOREIGN PATENT DOCUMENTS

GB 190626200 A * 4/1907
KR 10-2014-0083635 A 7/2014

* cited by examiner

*Primary Examiner* — Stephen Choi
(74) *Attorney, Agent, or Firm* — Lewis Roca Rothgerber Christie LLP

(57) ABSTRACT

A film cutting apparatus includes: a punch plate including a first punch protruded on an upper surface and a second punch protruded on a lower surface; a first die plate having a first hole corresponding to the first punch, the first die plate providing a surface on which a film is provided; a second die plate having a second hole corresponding to the second punch, the second die plate providing a surface on which a film is provided; at least two guide bars penetrating the first die plate and the punch plate and fixed to the second die plate; a first elastic member between the first die plate and the punch plate; a second elastic member between the punch plate and the second die plate; and an elevator configured to press the first die plate.

11 Claims, 3 Drawing Sheets

FILM CUTTING APPARATUS

CROSS-REFERENCE TO RELATED APPLICATION

The application claims priority to and the benefit of Korean Patent Application No. 10-2018-0150051, filed Nov. 28, 2018, which is hereby incorporated by reference for all purposes as if fully set forth herein.

BACKGROUND

1. Field

Aspects of some example embodiments relate to a film cutting apparatus.

2. Discussion

In recent years, a film-type semiconductor package of a chip on film (COF) method has been used to reduce the thickness and weight of a flat panel display.

The film-type semiconductor package may include a base film, a semiconductor integrated circuit (IC) in the form of a chip mounted on the base film, and wirings printed on the base film to be electrically connected to the semiconductor integrated circuit.

The film-type semiconductor package may be manufactured in a rolled-up form or configuration, and may be cut in a desired shape according to a user's demand.

The Background section of the present Specification includes information that is intended to provide context to example embodiments, and the information in the present Background section does not necessarily constitute prior art.

SUMMARY

Aspects of some example embodiments relate to a film cutting apparatus and, for example, to a film cutting apparatus for forming a film-type semiconductor package into a desired shape.

One or more example embodiments may include a film cutting apparatus which may reduce the time and cost required for forming a film-type semiconductor package.

One or more example embodiments may also include a film cutting apparatus capable of increasing an efficiency of a production process.

According to some example embodiments, a film cutting apparatus may include: a punch plate including a first punch protruded on an upper surface and a second punch protruded on a lower surface; a first die plate having a first hole corresponding to the first punch, the first die plate providing a surface on which a film is provided; a second die plate having a second hole corresponding to the second punch, the second die plate providing a surface on which a film is provided; at least two guide bars penetrating the first die plate and the punch plate and fixed to the second die plate; a first elastic member provided between the first die plate and the punch plate; a second elastic member provided between the punch plate and the second die plate; and an elevator configured to press the first die plate.

The first punch and the second punch may correspond to each other.

Each of the first die plate, the punch plate, and the second die plate may have through holes, and the at least two guide bars may be inserted through the through holes.

The first elastic member and the second elastic member may be provided so that the at least two guide bars penetrate an inside thereof.

A length of the first elastic member may greater than that of the second elastic member and an elastic modulus of the first elastic member may larger than that of the second elastic member.

Each surface of the first and second die plates on which the film is provided may include a guide groove into which the film is inserted.

According to some example embodiments, a film cutting apparatus may include a first punch plate including a first punch protruded on an upper surface; a first die plate having a first hole corresponding to the first punch, the first die plate providing a surface on which a film is provided; a second punch plate below the first punch plate and having a second punch protruded on a lower surface; a second die plate having a second hole corresponding to the second punch, the second die plate providing a surface on which a film is provided; at least two guide bars penetrating the first die plate, the first punch plate and the second punch plate and fixed to the second die plate; a first elastic member provided between the first die plate and the first punch plate; a second elastic member provided between the second punch plate and the second die plate; and an elevator configured to press the first die plate.

The first punch and the second punch may correspond to each other.

Each of the first die plate, the first punch plate, the second punch plate, and the second die plate may have through holes, and the at least two guide bars may be inserted through the through holes.

The first elastic member and the second elastic member may be provided so that the at least two guide bars penetrate an inside thereof.

A length of the first elastic member may greater than that of the second elastic member and an elastic modulus of the first elastic member may larger than that of the second elastic member.

Each surface of the first and second die plates on which the film is provided may include a guide groove into which the film is inserted.

BRIEF DESCRIPTION OF THE DRAWINGS

The accompanying drawings, which are included to provide a further understanding of aspects of the inventive concepts, and are incorporated in and constitute a part of this specification, illustrate example embodiments of the inventive concepts, and, together with the description, serve to explain principles of the inventive concepts.

DETAILED DESCRIPTION

Figure 1:
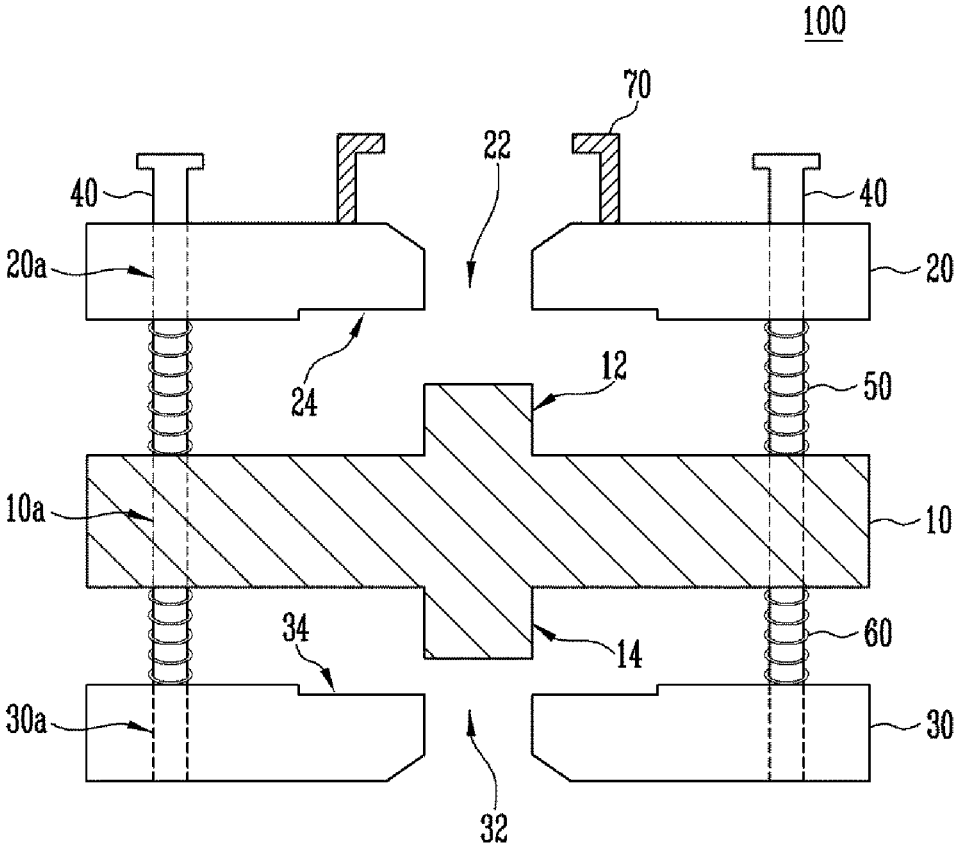
FIG. 1 is a cross-sectional view illustrating a film cutting apparatus according to some example embodiments of the invention.

Hereinafter, aspects of some example embodiments of the present invention will be described in more detail with reference to the accompanying drawings. The following example embodiments are provided so that those skilled in the art will be able to fully understand the invention. The embodiments can be modified in various ways. The scope of the invention is not limited to the example embodiments described below.

In the example embodiments, the terms first, second, etc. are not used in a limiting sense and are used for the purpose of distinguishing one element from another. Also, an expression representing the singular may include an expression representing a plurality unless it is clearly different in context.

Also, when a layer, a region, an element, or the like is referred to as being "connected" in the embodiment, it will be understood that when a layer, a region, or an element is directly connected as well as layers, regions, or elements are indirectly connected to each other. For example, when a layer, a region, an element, or the like is electrically connected, not only when a layer, a region, an element, or the like is directly connected each other, as well as a case where another layer, region, element, or the like is interposed therebetween and indirectly connected thereto.

The sizes of the elements shown in the drawings may be exaggerated or reduced for convenience of explanation. For example, the size and thickness of each element are arbitrarily shown for convenience of explanation, and thus the invention is not necessarily limited to those shown in the drawings.

Figure 2:
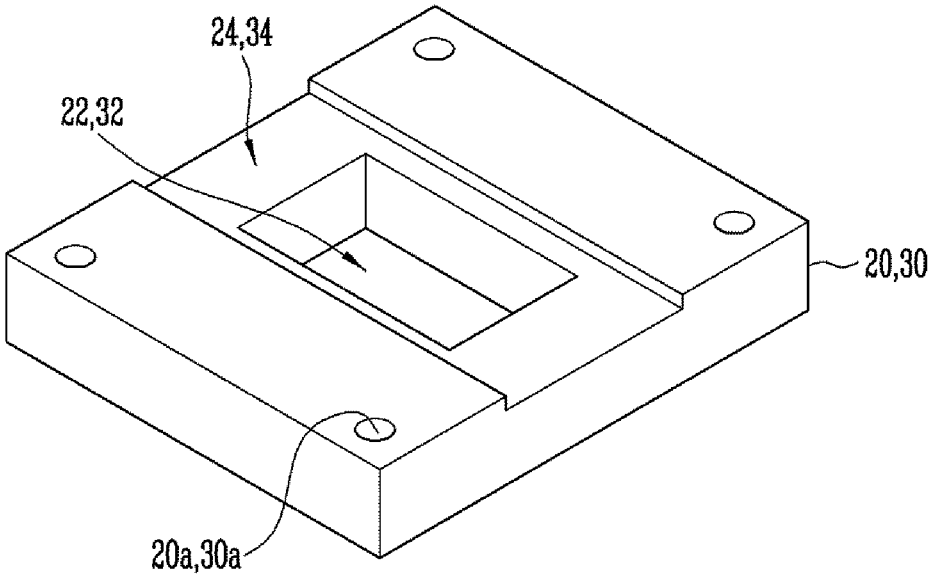
FIG. 2 is a perspective view illustrating a die plate according to some example embodiments of the invention.

FIG. 1 is a cross-sectional view illustrating a film cutting apparatus according to some example embodiments of the present invention. FIG. 2 is a perspective view illustrating a die plate according to some example embodiments of the present invention.

Referring to FIG. 1, a film cutting apparatus 100 may include one punch plate 10 and two die plates 20 and 30 located at a top and bottom of the punch plate 10, respectively. The punch plate 10 and the die plates 20 and 30 may be made of a common mold material.

The punch plate 10 may be in the form of a flat plate having a thickness (e.g., a predetermined thickness). The punch plate 10 may include a first punch 12 protruding from an upper surface thereof and a second punch 14 protruding from a lower surface thereof.

The first punch 12 and the second punch 14 may be arranged to correspond to each other (e.g., overlap when viewed from a plan view) at a center of the punch plate 10 and may have the same size and shape as each other.

The first punch 12 and the second punch 14 may be configured as a hexahedron having a cross section of, for example, a square, a rectangle, a polygon, a circle or the like depending on the size and shape of a film-type semiconductor package to be formed.

The first punch 12 and the second punch 14 may be integrally formed with the punch plate 10 or may be separately manufactured and then coupled to the punch plate 10.

In addition, the punch plate 10 may include through holes 10*a* located at both sides of the first punch 12 and the second punch 14. For example, the through holes 10*a* may be arranged adjacent to edges of the punch plate 10.

The first die plate 20 may be located above the punch plate 10 and the second die plate 30 may be located below the punch plate 10.

Referring to FIGS. 1 and 2, the first die plate 20 may be in the form of a flat plate having a thickness (e.g., a predetermined thickness) and a film may be provided and seated on a surface 24 facing the first punch 12. The surface 24 on which the film is provided may include a guide groove such that the film inserted therein is easily aligned and advanced.

The first die plate 20 may have a first hole 22 corresponding to the first punch 12. The first hole 22 may overlap the surface 24 on which the film is provided and may have a size and shape such that the first punch 12 can be inserted within a tolerance range (e.g., a predetermined tolerance range).

For example, the first hole 22 may include a portion into which the first punch 12 is inserted and a portion through which a cut film is discharged. A width of the portion where the first punch 12 is inserted may be approximately the same as that of the first punch 12 in order to cut the film but a width of the portion where the film is discharged may be wider so that the cut film can be more easily discharged.

In addition, the first die plate 20 may include through holes 20*a* located at both sides of the first holes 22. For example, the through holes 20*a* may be arranged adjacent to edges of the first die plate 20.

The second die plate 30 may be in the form of a flat plate having a thickness (e.g., a predetermined thickness) and a film may be provided and seated on a surface 34 facing the second punch 14. The surface 34 on which the film is provided may include a guide groove such that the film inserted therein is more easily aligned and advanced.

The second die plate 30 may have a second hole 32 corresponding to the second punch 14. The second hole 32 may overlap the surface 34 on which the film is provided and may have a size and shape such that the second punch 14 can be inserted within a tolerance range (e.g., a predetermined tolerance range).

For example, the second hole 32 may include a portion into which the second punch 14 is inserted and a portion through which a cut film is discharged. A width of the portion where the second punch 14 is inserted may be approximately the same as that of the second punch 14 in order to cut the film. However, the portion where the film is discharged may have a greater width so that the cut film can be more easily discharged.

In addition, the second die plate 30 may include through holes 30*a* located at both sides of the second holes 32. For example, the through holes 30*a* may be arranged adjacent to edges of the second die plate 30.

The first die plate 20, the punch plate 10 and the second die plate 30 may be aligned with each other by guide bars 40 inserted through the through holes 10*a*, 20*a* and 30*a*. At this time, the guide bars 40 may be fixed while being inserted into the through holes 30*a* of the second die plate 30. In this state, the first die plate 20 and the punch plate 10 may move downward and upward along the guide bars 40.

For a stable operation of the film cutting apparatus 100, a bottom surface of the second die plate 30 may be fixed on a flat bottom.

The film cutting apparatus 100 according to some example embodiments of the present invention may further include a first elastic member 50 provided between the first die plate 20 and the punch plate 10, a second elastic member 60 provided between the punch plate 10 and the second die plate 30, and an elevator (or elevating means) 70 for pressing the first die plate 20.

The first elastic member 50 and the second elastic member 60 may be, for example, in the form of a spring, and the guide bars 40 may be inserted to penetrate the inside thereof.

The first elastic member 50 and the second elastic member 60 may have a length and/or elastic modulus (e.g., a predetermined length and/or elastic modulus). The length and elastic modulus of the first elastic member 50 may be different from those of the second elastic member 60.

A distance between the first die plate 20 and the punch plate 10 may be determined by the length and/or elastic modulus of the first elastic member 50 and a distance between the punch plate 10 and the second die plate 30 may be determined by the length and/or elastic modulus of the second elastic member 60.

The elevator (or elevating means) 70 may be provided above the first die plate 20.

Although not shown in FIG. 1, the elevator (or elevating means) 70 may be mechanically coupled to a driver (or driving means) that provides a driving force for moving the first die plate 20 up and down.

Aspects of some example embodiments of the present invention will be described in more detail with reference to FIGS. 3 and 4.

Figure 3:
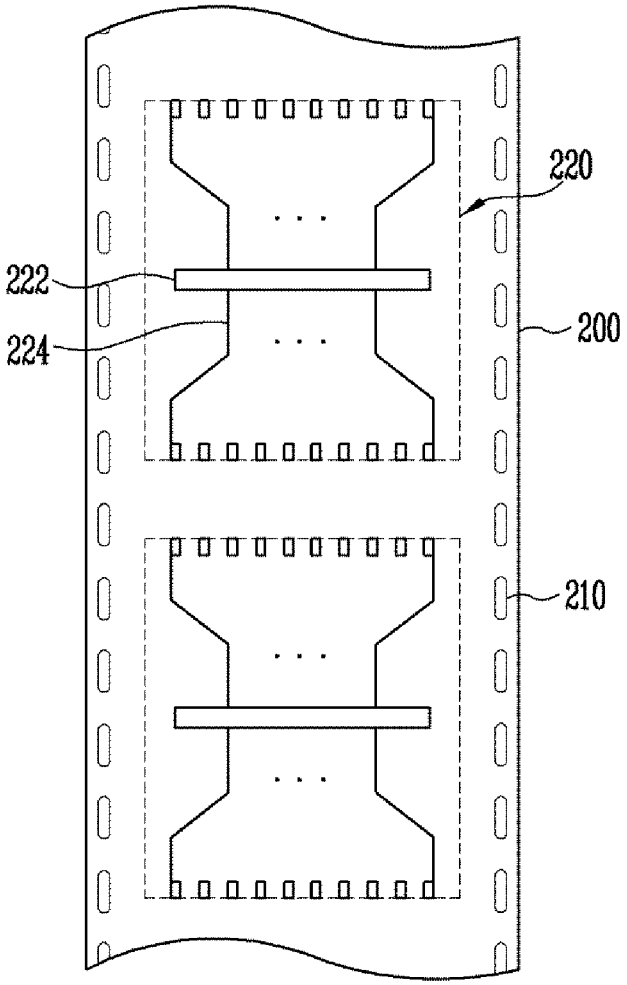
FIG. 3 is a plan view for explaining an example of a film-type semiconductor package according to some example embodiments of the invention.

FIG. 3 is a plan view for explaining an example of a film-type semiconductor package applied to the invention. FIG. 4 is a cross-sectional view illustrating an operation of the film cutting apparatus according to some example embodiments of the present invention.

Referring to FIG. 3, a film-type semiconductor packages 220 may be continuously formed on a base film 200 in the form of a tape at intervals (e.g., predetermined intervals).

Each of the film-type semiconductor packages 220 may include the base film 200 made of, for example, polyamide or polyimide, a semiconductor integrated circuit 222 mounted on the base film 200 in a chip form and wirings 224 printed on the base film 200 to be electrically connected to the semiconductor integrated circuit 222.

The film-type semiconductor packages 220 may be separated from each other by cutting the base film 200.

The film cutting apparatus 100 according to some example embodiments of the present invention can be used to separate the film-type semiconductor packages 220 from each other.

Referring to FIG. 1, in the film cutting apparatus 100, the first die plate 20 and the punch plate 10 may be spaced apart from each other by the first elastic member 50, and the punch plate 10 and the second die plate 30 may be spaced apart from each other by the second elastic member 60.

Figure 4:
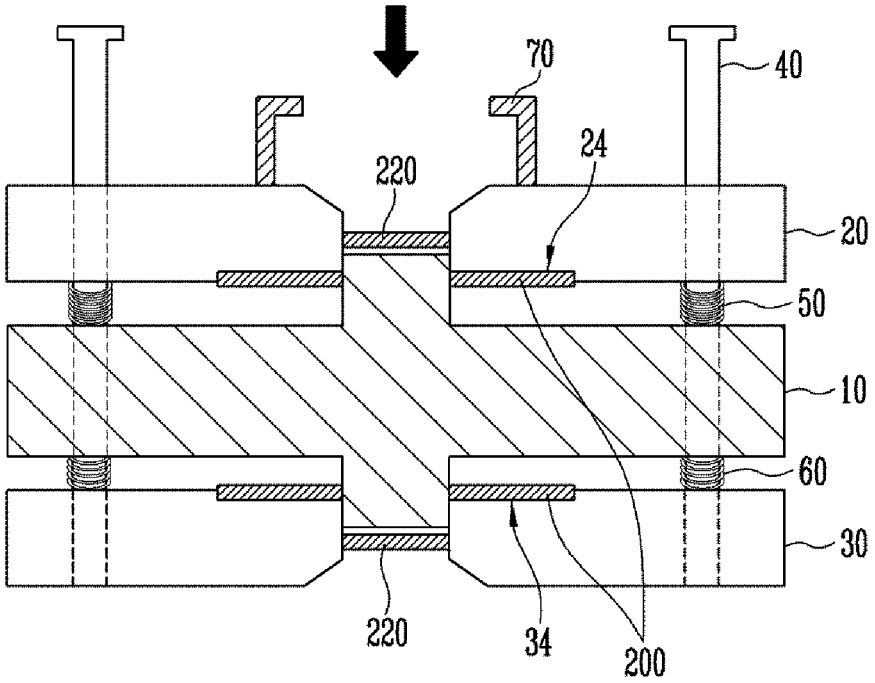
FIG. 4 is a cross-sectional view illustrating an operation of the film cutting apparatus according to some example embodiments of the invention.

Referring to FIG. 4, in this state, a film 200 may be provided in a guide groove 24 of the first die plate 20 and the film 200 may be provided in a guide groove 34 of the second die plate 30. FIG. 4 shows a state in which the film 200 advances from the front to the rear.

The film 200 may be unwound from the rolled-up configuration in which the film 200 is wound on a reel, and may then be provided to the guide groove 24 or 34 via a plurality of rollers as required.

In another embodiment, protrusions are provided along both side edges of the guide grooves 24 and 34 so that the film 200 can be easily aligned and fixed, and sprocket holes 210 formed along both side edges of the film 200 may be inserted into the protrusions.

A driving force is supplied from the driver (or driving means) to the elevator (or elevating means) 70 and the elevator (or elevating means) 70 transmits the driving force to the first die plate 20 so that the first die plate 20 can move downward.

The first die plate 20 is lowered along the guide bars 40 while the second die plate 30 is fixed so that the first and second elastic members 50 and 60 are compressed and the first die plate 20, the punch plate 10, and the second die plate 30 can be pressed against each other.

When the first punch 12 of the punch plate 10 is inserted into the first hole 22 of the first die plate 20 and the second punch 14 of the punch plate 10 is inserted into the second die plate 20, portions (e.g., predetermined portions) of the films 200 can be cut and the film-type semiconductor packages 220 can be separated from the films 200, respectively. Each of the film-type semiconductor packages 220 can be discharged on opposite sides of the first hole 22 and the second hole 32.

For example, when the length and/or elastic modulus of the first elastic member 50 is greater than the those of the second elastic member 60, the second punch 14 of the punch plate 10 is first inserted into the second hole 32 of the second die plate 30 and then the first punch 12 of the punch plate 10 is inserted into the first hole 22 of the first die plate 20. Therefore, the film-type semiconductor packages 220 may be separated at different times from each other.

Thereafter, a driving force is supplied from the driver (or driving means) to the elevator (or elevating means) 70 and the elevator (or elevating means) 70 transmits the driving force to the first die plate 20 so that the first die plate 20 can move upward.

The first die plate 20 and the punch plate 10 are returned to their original positions while the first and second elastic members 50 and 60 are restored by elasticity, and the first die plate 20, the punch plate 10 and the second die plate 30 may be spaced apart from each other at a distance (e.g., a predetermined distance).

As described above, the film cutting apparatus 100 according to some example embodiments of the present invention can produce two film-type semiconductor packages 220 by a single cutting operation. When the length and/or elastic modulus of each of the first elastic member 50 and the second elastic member 60 are adjusted as needed, production time points of the two film-type semiconductor packages 220 can be controlled differently.

Figure 5:
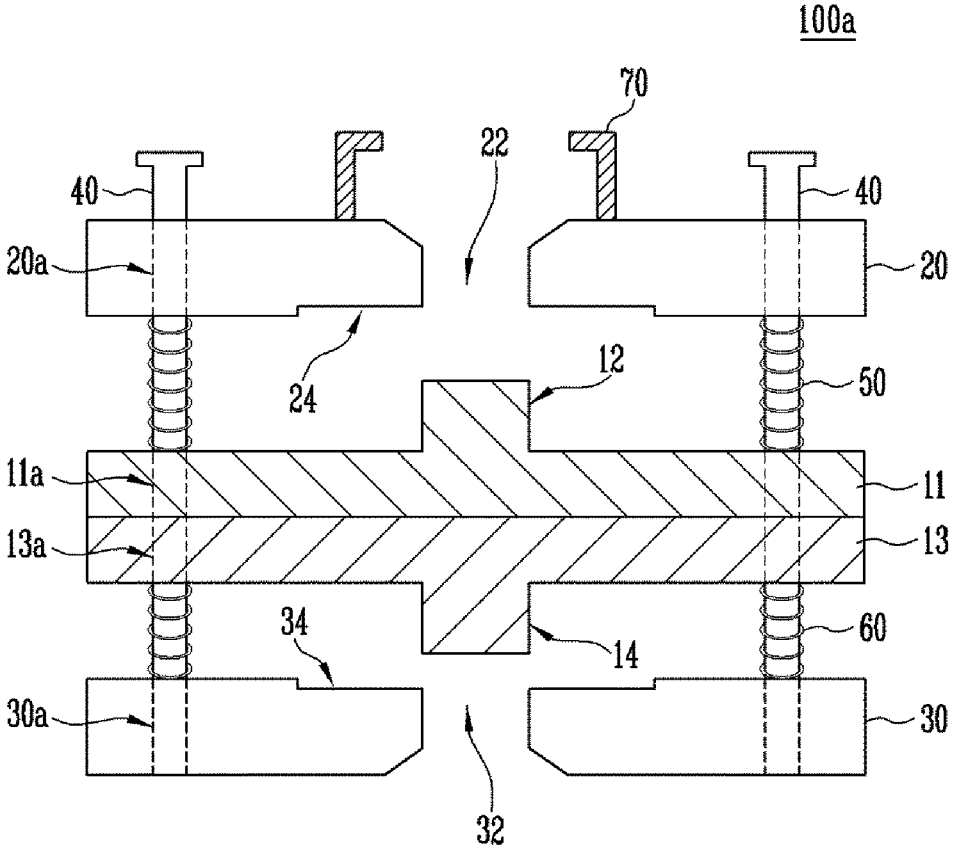
FIG. 5 is a cross-sectional view illustrating a film cutting apparatus according to some example embodiments of the invention.

FIG. 5 is a cross-sectional view illustrating a film cutting apparatus according to some example embodiments of the present invention.

A film cutting apparatus 100*a* of FIG. 5 differs from the film cutting apparatus 100 of FIG. 1 in terms of a structure of the punch plate 10. Therefore, only different configurations will be described.

Referring to FIG. 5, a punch plate may include a first punch plate 11 having a first punch 12 protruding upward and a second punch plate 13 having a second punch 14 protruding downward.

The first punch 12 may be integrally formed with the first punch plate 11 or may be separately manufactured and then coupled to the first punch plate 11. In addition, the second punch 14 may be integrally formed with the second punch plate 13, or may be separately manufactured and then coupled to the second punch plate 13.

The first punch plate 11 may include through holes 11*a* located at both sides of the first punch 12 and the second punch plate 13 may include through holes 13*a* located at both sides of the second punch 14. For example, the through holes 11*a* and 13*a* may be arranged adjacent to edges of the first and second punch plates 11 and 13.

A large pressure may be repeatedly applied to the first and second punch plates 11 and 13 during an operation of the film cutting apparatus 100*a*. For example, the first and second punches 12 and 14 must have precise dimensions, but repeated pressure applied to the first and second punches 12 and 14 may cause deformation that deviates from the tolerance range.

The film cutting apparatus 100*a* according to the embodiment includes the first and second punch plates 11 and 13 separated from each other. Because the first and second punch plates 11 and 13 can be manufactured separately from each other and the first and second punches 12 and 14 can also be manufactured separately from each other, an amount of deformation of the first and second punches 12 and 14 due to pressure repeatedly applied to the first and second punches 12 can be reduced as compared with the embodiment of FIG. 1. In addition, when deformation occurs in any one of the first and second punches 12 and 14, damage can be reduced or only a deformed one of the first and second punches 12 and 14 can be easily exchanged.

The film cutting apparatus according to some example embodiments of the present invention can produce two film-type semiconductor packages by a single cutting operation, so that the production time and cost can be reduced. In addition, times at which the two film-type semiconductor packages are produced can be adjusted differently as needed, thereby increasing efficiency of the production process.

As described above, aspects of some example embodiments of the present invention have been disclosed through the detailed description and the drawings. It is to be understood that the terminology used herein is for the purpose of describing the invention only and is not used to limit the scope of the invention described in the claims. Therefore, those skilled in the art will appreciate that various modifications and equivalent embodiments are possible without departing from the scope of the invention. Accordingly, the true scope of the invention should be determined by the technical idea of the appended claims, and their equivalents.

What is claimed is:

1. A film cutting apparatus comprising:

a punch plate including a first punch protruded on an upper surface and a second punch protruded on a lower surface;

a first die plate having a first hole corresponding to the first punch, the first die plate providing a surface on which a first film is provided;

a second die plate having a second hole corresponding to the second punch, the second die plate providing a surface on which a second film is provided;

at least two guide bars penetrating the first die plate and the punch plate and fixed to the second die plate;

a first elastic member between the first die plate and the punch plate;

a second elastic member between the punch plate and the second die plate; and an elevator configured to press the first die plate, wherein a length of the first elastic member is greater than that of the second elastic member.

2. The film cutting apparatus of claim 1, wherein the first punch and the second punch correspond to each other.

3. The film cutting apparatus of claim 1, wherein each of the first die plate, the punch plate, and the second die plate has through holes, and the at least two guide bars are inserted through corresponding ones of the through holes.

4. The film cutting apparatus of claim 1, wherein the first elastic member and the second elastic member are provided so that the at least two guide bars penetrate an inside thereof.

5. The film cutting apparatus of claim 1, wherein each surface of the first and second die plates on which a corresponding one of the first and second films is provided includes a guide groove into which a corresponding one of the first and second films is inserted.

6. A film cutting apparatus comprising:

a first punch plate including a first punch protruded on an upper surface;

a first die plate having a first hole corresponding to the first punch, the first die plate providing a surface on which a first film is provided;

a second punch plate below the first punch plate and having a second punch protruded on a lower surface;

a second die plate having a second hole corresponding to the second punch, the second die plate providing a surface on which a second film is provided;

at least two guide bars penetrating the first die plate, the first punch plate and the second punch plate and fixed to the second die plate;

a first elastic member between the first die plate and the first punch plate;

a second elastic member between the second punch plate and the second die plate; and an elevator configured to press the first die plate, wherein a length of the first elastic member is greater than that of the second elastic member.

7. The film cutting apparatus of claim 6, wherein the first punch and the second punch correspond to each other.

8. The film cutting apparatus claim 6, wherein each of the first die plate, the first punch plate, the second punch plate, and the second die plate has through holes, and the at least two guide bars are inserted through the through holes.

9. The film cutting apparatus of claim 6, wherein the first elastic member and the second elastic member are provided so that the at least two guide bars penetrate an inside thereof.

10. The film cutting apparatus of claim 6, wherein each surface of the first and second die plates on which a corresponding one of the first and second films is provided includes a guide groove into which a corresponding one of the first and second films is inserted.

11. A film cutting apparatus comprising:

a punch plate including a first punch protruded on an upper surface and a second punch protruded on a lower surface;

a first die plate having a first hole corresponding to the first punch, the first die plate providing a surface on which a first film is provided;

a second die plate having a second hole corresponding to the second punch, the second die plate providing a surface on which a second film is provided;

at least two guide bars penetrating the first die plate and the punch plate and fixed to the second die plate;

a first elastic member between the first die plate and the punch plate;

a second elastic member between the punch plate and the second die plate; and an elevator configured to press the first die plate, wherein an elastic modulus of the first elastic member is larger than that of the second elastic member.

* * * * *